US006561165B1

(12) United States Patent
Hlousek

(10) Patent No.: US 6,561,165 B1
(45) Date of Patent: May 13, 2003

(54) COMMON RAIL INJECTOR

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,468

(22) PCT Filed: Jun. 21, 2000

(86) PCT No.: PCT/DE00/02028

§ 371 (c)(1),
(2), (4) Date: Apr. 23, 2001

(87) PCT Pub. No.: WO01/00986

PCT Pub. Date: Jan. 4, 2001

(30) Foreign Application Priority Data

Jun. 24, 1999 (DE) ..... 199 28 906

(51) Int. Cl.[7] ..... F02M 41/00
(52) U.S. Cl. ..... 123/467; 123/447
(58) Field of Search ..... 123/467, 496, 123/447, 446, 456

(56) References Cited

U.S. PATENT DOCUMENTS 4,246,876 A * 1/1981 Bouwkamp et al. ..... 123/467
4,306,680 A * 12/1981 Smith ..... 239/585
4,566,416 A 1/1986 Berchtold
4,627,571 A * 12/1986 Kato et al. ..... 239/90
4,805,580 A * 2/1989 Buisson et al. ..... 123/506
4,911,127 A * 3/1990 Perr ..... 123/446
5,012,786 A * 5/1991 Voss ..... 123/467
5,524,826 A 6/1996 Mueller et al.
5,526,792 A * 6/1996 Guth et al. ..... 123/467

FOREIGN PATENT DOCUMENTS

DE 31 51 065 A1 7/1983
DE 44 227 378 A1 2/1996
DE 197 15 234 A1 6/1998
DE 197 16 220 A1 10/1998

* cited by examiner

*Primary Examiner*—Carl S. Miller
(74) *Attorney, Agent, or Firm*—Ronald E. Greigg

(57) ABSTRACT

The invention relates to a common rail injector for injecting fuel in a common rail injection system of an internal combustion engine, in particular a large diesel engine, having an injector housing which communicates with a central high-pressure reservoir and in which a nozzle needle can move axially counter to the initial stress of a nozzle spring which is contained in a nozzle spring chamber, in order to adjust the injection onset and the injection quantity as a function of the position of a 3/2-way valve. In order to improve the damping behavior in a common rail injection system, an injector pressure reservoir is integrated into the injector housing and communicates with the central high-pressure reservoir independent of the position of the 3/2-way valve.

11 Claims, 1 Drawing Sheet

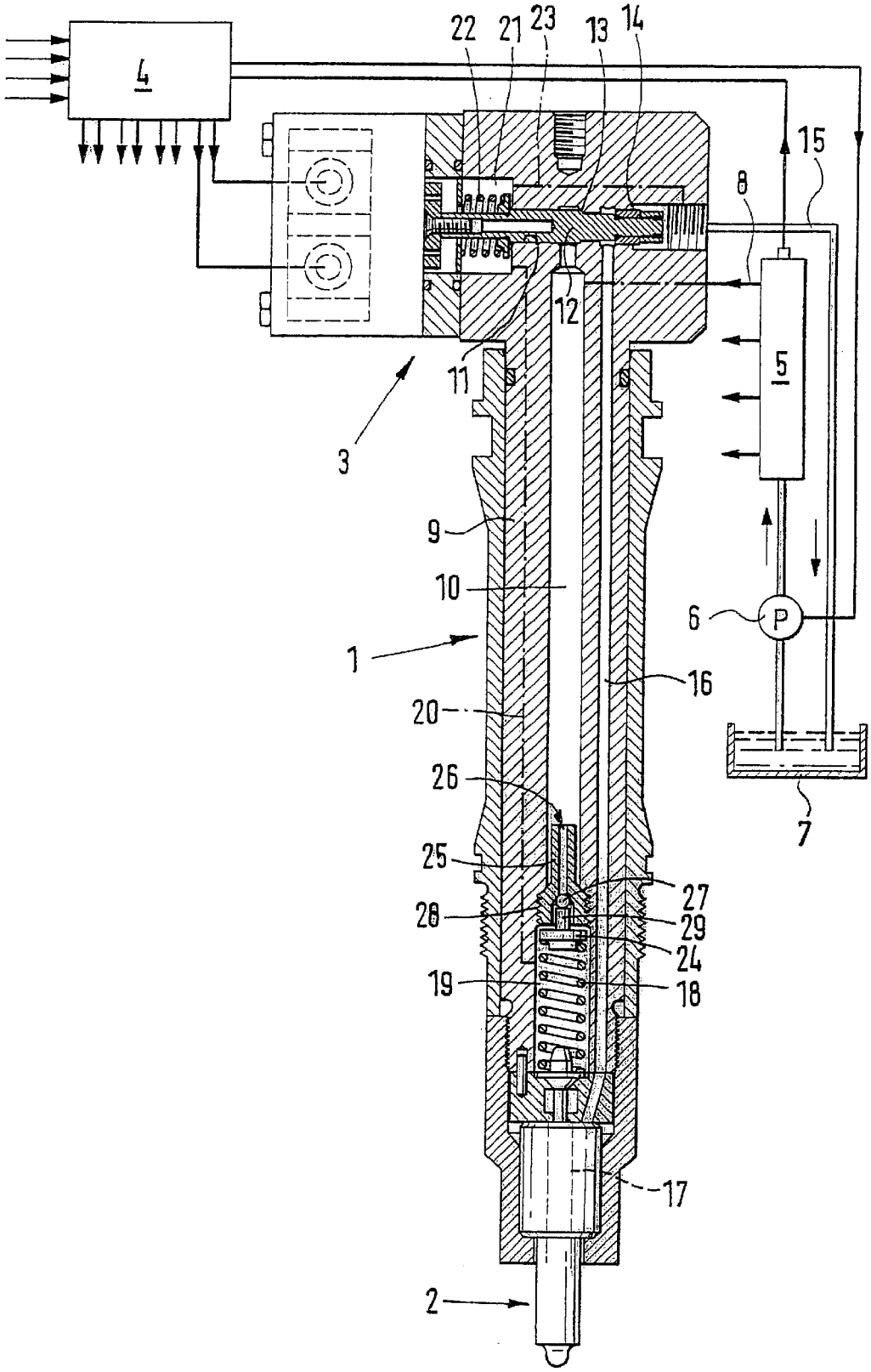
4
22
21
23
13
14
15
8
12
11
5
3
9
10
6
P
1
16
20
26
7
25
27
28
29
24
19
18
17
2

COMMON RAIL INJECTOR

CROSS-REFERENCE TO RELATED APPLICATIONS

This application is a 35 USC 371 application of PCT/DE 00/02028 filed on Jun. 21, 2000.

BACKGROUND OF THE INVENTION

1. Field of the Invention

The invention relates to a common rail injector for injecting fuel in a common rail injection system of an internal combustion engine, in particular a large diesel engine, having an injector housing which communicates with a central high-pressure reservoir and in which a nozzle needle can move axially counter to the initial stress of a nozzle spring which is contained in a nozzle spring chamber, in order to adjust the injection onset and the injection quantity as a function of the position of a 3/2-way valve.

2. Description of the Prior Art

In known common rail injection systems, a high-pressure pump feeds the fuel into the central pressure reservoir, which is referred to as the common rail. High-pressure lines lead from the high-pressure reservoir to the individual injectors, which are associated with the cylinders of the engine. The injectors are individually triggered by the engine electronics. The rail pressure prevails at a pressure-balanced 3/2-way solenoid valve which keeps the high-pressure bores to the conventional injector free of pressure. Only when the magnet is supplied with current does the 3/2-way solenoid valve open the connection from the rail to the injector and the fuel travels into the combustion chamber via the nozzle needle, which has lifted up counter to the spring force. The injection onset and the end of injection are thus determined by the beginning and end of the power supply to the magnet. The duration of the power supply is decisive for the injection quantity.

Pressure waves occur during operation of the injection system and are damped in the central high-pressure reservoir. In order to achieve a favorable damping action, the volume of the central high-pressure reservoir must be of sufficient size. An increasing volume of the central high-pressure reservoir, however, has a negative influence on the starting behavior and the dynamic behavior of the injection system because the time required for changing the system pressure increases.

SUMMARY OF THE INVENTION

The object of the present invention is to improve the damping behavior in a common rail injection system.

In a common rail injector for injecting fuel in a common rail injection system of an internal combustion engine, in particular a large diesel engine, having an injector housing which communicates with a central high-pressure reservoir and in which a nozzle needle can move axially counter to the initial stress of a nozzle spring which is contained in a nozzle spring chamber, in order to adjust the injection onset and the injection quantity as a function of the position of a 3/2-way valve, the object is attained by virtue of the fact that an injector pressure reservoir is integrated into the injector housing and communicates with the central high-pressure reservoir independent of the position of the 3/2-way valve. The pressure reservoir is used to damp the pressure waves coming from the central pressure reservoir during and after the injection.

One particular embodiment of the invention is characterized in that the volume of the injector pressure reservoir is 10 to 20 times the maximal injection quantity.

This value has turned out to be particularly advantageous in experiments carried out within the scope of the current invention.

Another particular embodiment of the invention is characterized in that the injector pressure reservoir communicates with a pressure-free chamber by means of a damping unit integrated into the injector housing. The total volume of the injector pressure reservoir and the central high-pressure reservoir can be considerably reduced as a result of the damping achieved by the damping unit.

Another particular embodiment of the invention is characterized in that the damping unit includes a damping throttle and a safety valve. Normally, the central high-pressure reservoir is equipped with a safety valve which opens in the event of an overpressure. This can be the case, for example, if the system pressure control circuit is not functioning properly. In the event of a possible mechanical failure of the safety valve controlled by the system pressure control circuit, serious damage to the engine can occur. Integrating the safety valve into the injector housing increases system safety. In addition, the safety valve normally provided in the central high-pressure reservoir can be eliminated.

Another particular embodiment of the invention is characterized in that the damping throttle is integrated into a screw plug which is screwed into the injector housing between the nozzle spring chamber and the injector pressure reservoir. This embodiment has the advantage that it can be produced in a particularly simple and inexpensive manner.

Another particular embodiment of the invention is characterized in that the injector pressure reservoir communicates with a fuel tank via the damping unit integrated into the injector housing. This offers the advantage that the injector pressure reservoir is discharged into the fuel tank if the pressure in the injector reservoir is greater than the system pressure.

BRIEF DESCRIPTION OF THE DRAWINGS

Other advantages, features, and details of the invention will be apparent from the detailed description contained herein below, taken in conjunction with the drawings, in which the single FIGURE is a longitudinal sectional view of an injector embodying the invention.

DESCRIPTION OF THE PREFERRED EMBODIMENTS

Referring now to the drawing, a conventional injection nozzle 2 is embodied at the end of an injector 1 oriented toward the bottom in the FIGURE. A solenoid valve 3 is disposed at the other end of the injector 1. The solenoid valve 3 is controlled by a control unit 4. The control unit 4 is coupled to a central high-pressure reservoir 5 and is coupled to a fuel pump unit 6. The fuel pump unit 6 delivers fuel from a fuel tank 7 into the central high-pressure reservoir 5. At the same time, the delivered fuel is subjected to high pressure in the fuel pump unit. The fuel that is acted on with the high pressure travels out of the central high-pressure reservoir 5 via a high-pressure line 8 into an elongated injector housing 9 which is the base body of the injector 1.

An injector pressure reservoir 10 is embodied in the injector housing 9. The injector pressure reservoir 10 is constituted by a section of a longitudinal bore through the injector housing 9. The injector pressure reservoir 10 communicates with the central high-pressure reservoir 5 via the high-pressure line 8. The end of the injector pressure reservoir 10 remote from the injector 2 feeds into a valve bore 11 which extends lateral to the longitudinal axis of the injector 1. A valve piston 12 is contained in the valve bore 11. The valve piston 12 can be moved axially in the valve bore 11 between two valve positions that are defined by valve seats 13 and 14.

The valve piston 12 is pushed toward the right by the initial stress of a valve spring 22 which is contained in a valve spring chamber 21. In this valve position, a high-pressure bore 16 communicates with the fuel tank 7 via a pressure-free discharge line 15. When the solenoid valve 3 is supplied with power, the valve piston 12 moves toward the left counter to the initial stress of the valve spring 22. The communication between the high-pressure bore 16 and the pressure-free discharge line 15 is thereby closed and the communication between the injector pressure reservoir 10 and a high-pressure bore 16 is opened by means of the valve bore 11.

The fuel that is acted on with high pressure can travel from the injector pressure reservoir 10, through the high-pressure bore 16, and to the injector 2. In the injector 2, a nozzle needle 17 can be moved back and forth counter to the force of a nozzle spring 18. The nozzle spring 18 is contained in a nozzle spring chamber 19 which is constituted by a section of the longitudinal bore through the injector housing 9. When the pressure is sufficient to lift the nozzle needle 17 from its seat, the fuel is injected.

The nozzle spring chamber 19 communicates with the valve spring chamber 21 via a bore 20. The valve spring chamber 21 in turn communicates via a bore 23 with the discharge line 15, which leads to the fuel tank 7.

The end of the nozzle spring 18 remote from the nozzle needle 17 rests against a spring plate 24. A projection 29 is embodied on the side of the spring plate 24 remote from the nozzle spring 18. The projection 29 protrudes into a recess that is embodied in a screw plug 25. The screw plug 25 is fastened in the injector housing 9 with the aid of a thread 28. A throttle bore 26 extends through the screw plug 25 in the direction of the longitudinal axis of the injector 1. At the end remote from the injector pressure reservoir 10, the throttle bore 26 is closed by a valve ball 27. The projection 29 that is embodied on the spring plate 24 presses against the valve ball 27.

If the pressure in the injector pressure reservoir 10 is greater than the system pressure, the spring plate 24 moves toward the injector 2 counter to the initial stress of the nozzle spring 18. As a result, the valve ball 27 unblocks the throttle bore 26 so that the fuel that is acted on with high pressure can travel from the injector pressure reservoir 10 into the nozzle spring chamber 9. From there, the fuel can escape into the fuel tank 7 via the bore 20, the valve spring chamber 21, the bore 23, and the discharge line 15.

The volume of the pressure reservoir 10 corresponds to 10 to 20 times the maximal injection quantity. The injector pressure reservoir 10 damps the pressure waves coming from the central pressure reservoir 5 during and after the injection.

The foregoing relates to preferred exemplary embodiments of the invention, it being understood that other variants and embodiments thereof are possible within the spirit and scope of the invention, the latter being defined by the appended claims.

I claim:

1. In a common rail injector for injecting fuel in a common rail injection system of an internal combustion engine, the injector having an injector housing (9) which communicates with a central high-pressure reservoir (5) and in which a nozzle needle (17) is supported for movement axially counter to the initial stress of a nozzle spring (18) which is contained in a nozzle spring chamber (19), in order to adjust the injection onset and the injection quantity as a function of the position of a 3/2-way valve (3), the improvement comprising an injector pressure reservoir (10) integrated into the injector housing (9) said injector pressure reservoir communicating with the central high-pressure reservoir (5) independent of the position of the 3/2-way valve (3), wherein the volume of the injector pressure reservoir (10) is 10 to 20 times the maximal injection quantity.

2. In a common rail injector for injecting fuel in a common rail injection system of an internal combustion engine, the injector having an injector housing (9) which communicates with a central high-pressure reservoir (5) and in which a nozzle needle (17) is supported for movement axially counter to the initial stress of a nozzle spring (18) which is contained in a nozzle spring chamber (19), in order to adjust the injection onset and the injection quantity as a function of the position of a 3/2-way valve (3), the improvement comprising an injector pressure reservoir (10) integrated into the injector housing (9) said injector pressure reservoir communicating with the central high-pressure reservoir (5) independent of the position of the 3/2-way valve (3), wherein said injector pressure reservoir (10) communicates with a pressure-free chamber (19) via a damping unit (25, 26, 27) that is integrated into the injector housing (9).

3. The injector according to claim 2, wherein said damping unit includes a damping throttle (26) and a safety valve (27).

4. The injector according to claim 3, wherein said damping throttle (26) is integrated into a screw plug (25) which is screwed into the injector housing (9) between the nozzle spring chamber (19) and the injector pressure reservoir (10).

5. The injector according to claim 3, wherein said injector pressure reservoir (10) communicates with a fuel tank (7) via the damping unit (25, 26, 27) that is integrated into the injector housing (9).

6. The injector according to claim 4, wherein said injector pressure reservoir (10) communicates with a fuel tank (7) via the damping unit (25, 26, 27) that is integrated into the injector housing (9).

7. In a common rail injector for injecting fuel in a common rail injection system of an internal combustion engine, the injector having an injector housing (9) which communicates with a central high-pressure reservoir (5) and in which a nozzle needle (17) is supported for movement axially counter to the initial stress of a nozzle spring (18) which is contained in a nozzle spring chamber (19), in order to adjust the injection onset and the injection quantity as a function of the position of a 3/2-way valve (3), the improvement comprising an injector pressure reservoir (10) integrated into the injector housing (9) said injector pressure reservoir communicating with the central high-pressure reservoir (5) independent of the position of the 3/2-way valve (3), wherein the volume of the injector pressure reservoir (10) is 10 to 20 times the maximal injection quantity and said injector pressure reservoir (10) communicates with a pressure-free chamber (19) via a damping unit (25, 26, 27) that is integrated into the injector housing (9).

8. The injector according to claim 7, wherein said damping unit includes a damping throttle (26) and a safety valve (27).

9. The injector according to claim 8, wherein said damping throttle (26) is integrated into a screw plug (25) which is screwed into the injector housing (9) between the nozzle spring chamber (19) and the injector pressure reservoir (10).

10. The injector according to claim 8, wherein said injector pressure reservoir (10) communicates with a fuel tank (7) via the damping unit (25, 26, 27) that is integrated into the injector housing (9).

11. The injector according to claim 9, wherein said injector pressure reservoir (10) communicates with a fuel tank (7) via the damping unit (25, 26, 27) that is integrated into the injector housing (9).

* * * * *